United States Patent [19]

Becatti

[11] Patent Number: 4,605,496

[45] Date of Patent: Aug. 12, 1986

[54] CLASSIFICATION SCREEN

[76] Inventor: Jorge Becatti, Monserrat 2195 Barrio Crisol Sud, Cordoba, Province of Cordoba, Argentina

[21] Appl. No.: 620,124

[22] Filed: Jun. 13, 1984

[30] Foreign Application Priority Data

Jun. 14, 1983 [AR] Argentina ..... 293333
May 17, 1984 [AR] Argentina ..... 296693

[51] Int. Cl.[4] ..... B07B 1/46
[52] U.S. Cl. ..... 209/394; 209/404
[58] Field of Search ..... 209/392-399, 209/408, 404

[56] References Cited

U.S. PATENT DOCUMENTS

| | | | |
|---|---|---|---|
| 405,660 | 6/1889 | Cornwall | 209/394 |
| 789,966 | 5/1905 | Ditch et al. | 209/394 |
| 803,156 | 10/1905 | Duggan | 209/397 |
| 1,747,124 | 2/1930 | Morrow | 209/397 |
| 2,413,382 | 12/1946 | Sargent et al. | 209/408 |
| 3,472,378 | 10/1969 | Payne | 209/394 |
| 4,502,493 | 3/1985 | Jones et al. | 209/394 |

FOREIGN PATENT DOCUMENTS

| | | | |
|---|---|---|---|
| 2214131 | 9/1973 | Fed. Rep. of Germany | 209/392 |
| 230632 | 3/1925 | United Kingdom | 209/394 |

*Primary Examiner*—S. Leon Bashore
*Assistant Examiner*—William Bond
*Attorney, Agent, or Firm*—Collard, Roe & Galgano

[57] ABSTRACT

A classification screen or sieve is provided having a plurality of elongated pieces, each piece having a substantially straight posterior edge, and an anterior edge downstream from said posterior edge having a plurality of alternating projections and notches. Each elongated piece being staggered or off-set with respect to the succeeding elongated piece without touching it and each of said elongated pieces being parallel to each other and vertically displaced from each other.

2 Claims, 9 Drawing Figures

FIG. 1
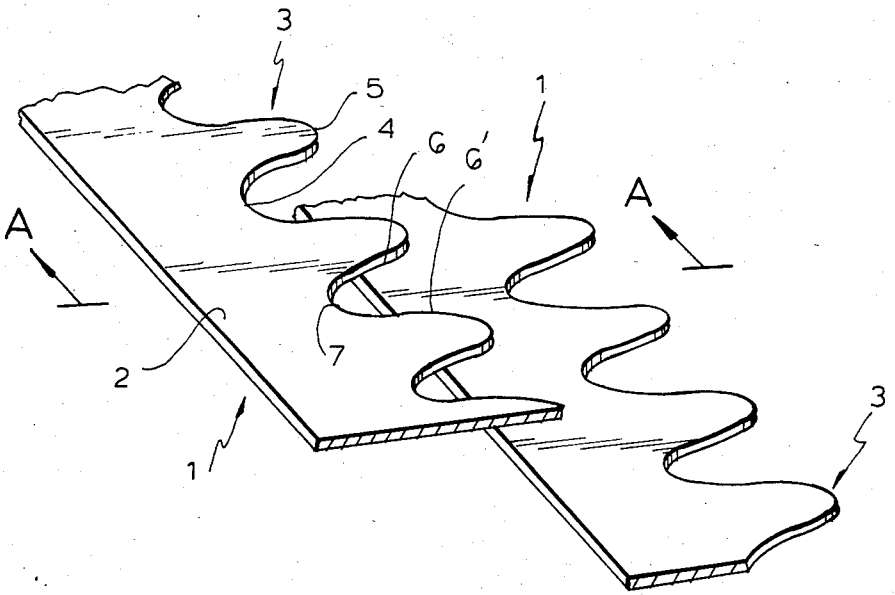
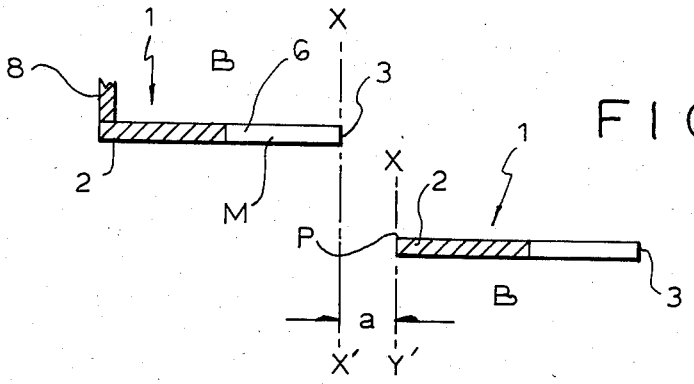
FIG. 2
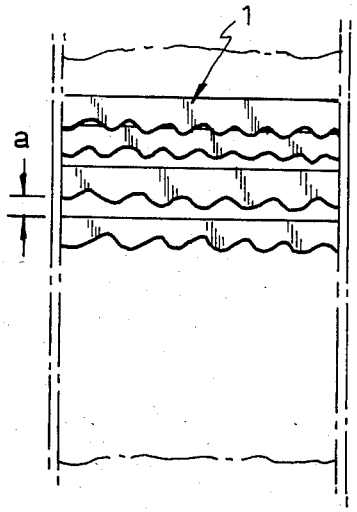
FIG. 3

FIG. 7
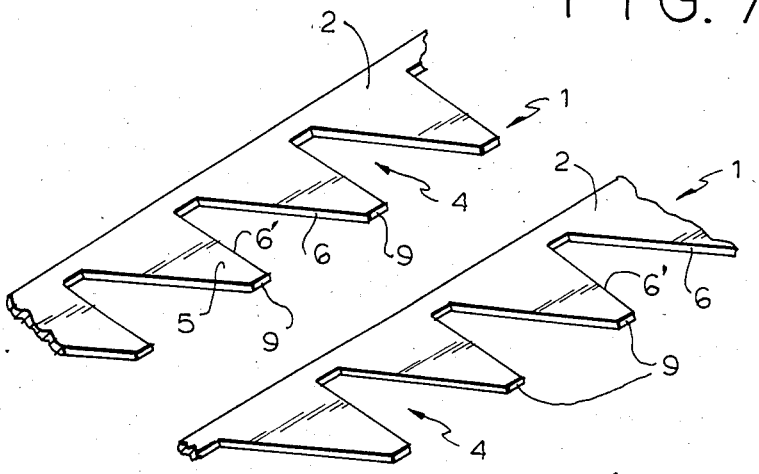
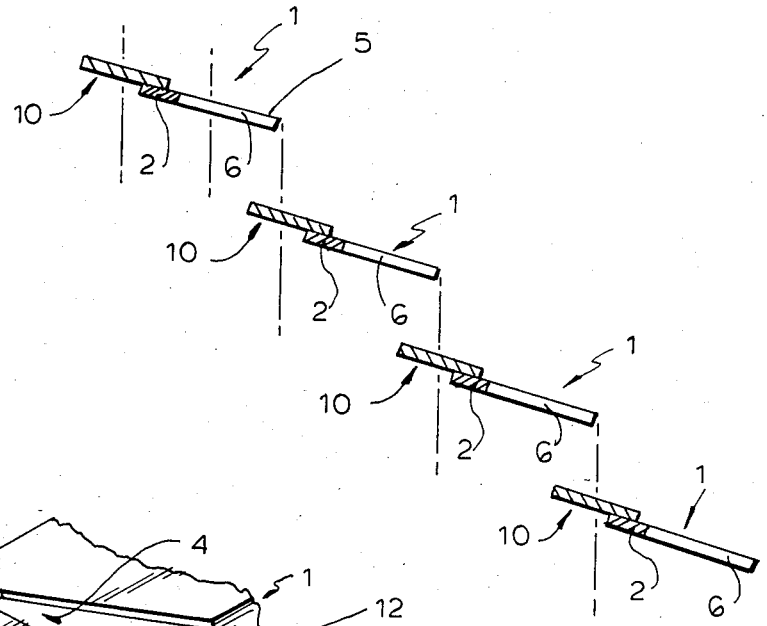
FIG. 8
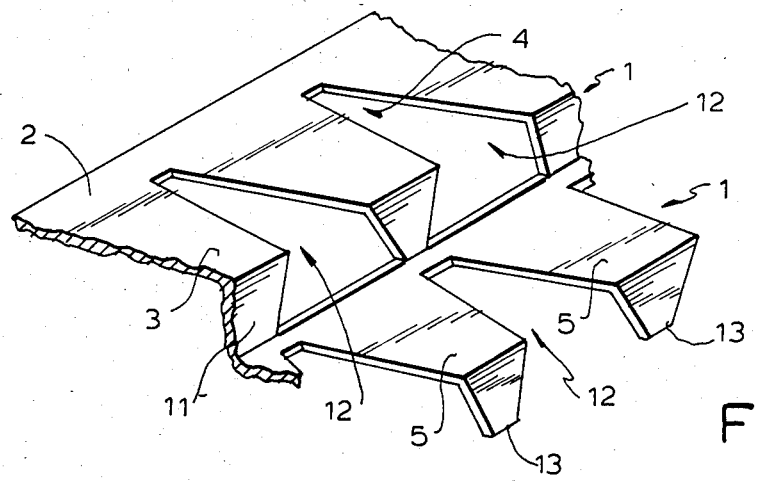
FIG. 9

CLASSIFICATION SCREEN

BACKGROUND OF THE INVENTION

The present invention relates to a novel classification screen or sieve. More specifically, the present invention covers a novel classification screen, which is understood to be any device capable of classifying according to size any object passing through it, thus dividing the object material into two groups. These two groups comprise a group whose grain-size permits the material to pass through the device, and another group whose size prevents the material from passing through the device, thereby establishing an operation of separating the respective material, such as, grain, stones, ore, etc.

Known screens or sieves generally consist of at least one bed arranged in general on an almost horizontal or inclined plane and subjected to a vibrational movement, usually intense, which can vary from a few hundred vibrations per minute to almost 1800 vibrations per minute, as a general rule.

This bed consists of a metallic mesh or plate perforated with a substantial number of holes passing through it, of constant size or area, which constitute the "mesh", or screening capacity of the device. For each bed, it is customary to provide a frame or any other structural element, which is capable of sustaining said mesh, netting or perforated plate, plus the weight of the material to be classified, subjected to the dynamic vibrational action. Thus, there is known and understood as "bed", the multiple number of openings of passage contained, substantially, on a single plane.

In such known screens, it is evident that for each "bed", there are a multiple number of passage orifices which are stationary and unmovable with respect to their physical arrangement and in their passage or average diameter.

Also, such screens are integrated with others, in a cascade arrangement of a multiple number of beds, one of them collecting and classifying the material which has passed through and been classified by the bed arranged immediately above.

Such known screens are, in general, very noisy; they subject their frames and the supporting base to substantial vibrations; they cannot be adjusted except by exchanging completely the bed or mesh contained in them, and they require a powerful motor. These factors lead to relatively high installation, operating and maintenance costs—not to mention the initial cost of acquisition which is high, because, from what has been stated, these are machines which require very strong frames.

It is, therefore, an object of the present invention to construct a lighter machine, subjected to a vibrational effect of less applied force and less speed (lower frequency), the screening size of which would not be a function of a continuous layer (whether a perforated plate or sheet of metal, or a woven mesh material), which would permit the possibility of adjustments in at least part of the bed in order to alter the size of the mesh, with a markedly reduced consumption of energy, and with a well regulated selectivity of classification.

SUMMARY OF THE INVENTION

This object is accomplished in accordance with the present invention by the provision of a classification screen, which contains at least one bed constituting a screening surface, each bed being equipped with a multiple number or plurality of basically laminar and elongated pieces, according to the width of the bed, and each elongated piece being arranged in a staggered or off-set manner with respect to the successive piece, and above the latter, without any of these laminar pieces touching the preceding one, or the following one, respectively. Each one of these laminar pieces has a posterior portion substantially without orifices and passages, and an anterior edge provided with a multiple number of alternating spaces and projections, providing a notching of said anterior edge. The arrangement of the sides of said notchings may vary from being parallel to each other and basically vertical or perpendicular to the longitudinal axis of the piece, to sides whose obliquity might be close to the horizontal or parallel with respect to the longitudinal axis of the piece. It is possible for said sides to be straight, curved or of compound geometry. The screen passage or mesh is determined between two generic points pertaining to each side of the same notching, and an intermediate point between the ends of same and pertaining to the posterior edge of the piece immediately down-stream of the bed.

On the basis of the combination referred to above, there are many embodiments which can be executed, but for the purpose of making clear the advantages outlined briefly—to which the user will be able to add many more-and in order to facilitate an understanding of the structural and functional characteristics of the novel screen according to the invention, there is described hereinafter a preferred embodiment of the invention, illustread with the attached drawing, with the clarification that, precisely because it is an example, it is not appropriate to ascribe to it a limitative character with respect to the scope of this invention, but instead, it merely has the purpose of explaining and illustrating the basic concept on which the invention is based.

Other objects and features of the present invention will become apparent from the following detailed description considered in connection with the accompanying drawing.

BRIEF DESCRIPTION OF THE DRAWINGS

In the drawing wherein similar reference characters denote similar elements throughout the several views:

FIG. 1 is a perspective view of two elongated, laminated pieces according to the present invention;

FIG. 2 is a cross sectional view taken along the line AA' of FIG. 1;

FIG. 3 is a partial plan view of a bed according to the present invention;

FIG. 7 is a perspective view of an embodiment wherein each piece is provided with polygonal extremities or prolongations;

FIG. 8 is a cross sectional view similar to FIG. 2 showing added features; and FIG. 9 is a perspective view of another embodiment of the present invention.

DETAILED DESCRIPTION OF THE DRAWINGS

Figure 4:
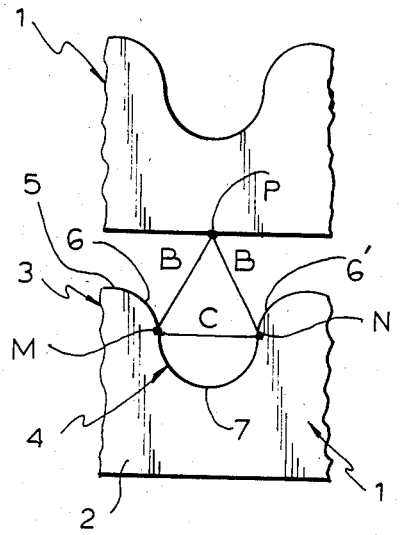
FIGS. 4, 5 and 6 are partial plan views of notch constructions, according to the present invention.
Figure 5:
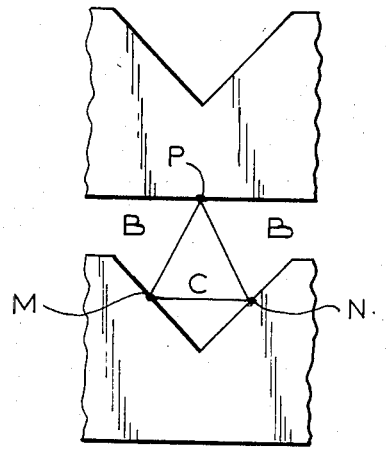

Now turning to the drawings, there are shown throughout longitudinal laminar pieces designated with the numeral 1, which it should be noted is to include all pieces which, according to this invention, have length as their predominant dimension. Included also are pieces that have substantial thickness and not necessarily laminar inasmuch as these pieces can be produced by casting, and need not necessarily be flat, since the pieces 1 can have corrugations, depressions and projecting edges on their surface, if this should be necessary. Such longitudinal pieces 1 may be formed of sheet metal or similar material.

Pieces 1, have, in general, a posterior or planar portion 2 without passages or orifices passing therethrough, and on their anterior edge 3, they are provided with a multiple number or plurality of spaces and projections, which define projections 4 and notches 5, which alternate along anterior edge 3. The position of the posterior edge 2 and of anterior edge 3 for each elongated piece 1, is defined by assuming the screen bed to be composed of a multiple number of these pieces 1, located with their greatest dimension or length transverse to the direction of advance of the material to be classified, and with the posterior edge being located up-stream with respect to the anterior edge, with reference to the direction of advance of the material. In other words, the posterior edges 2 face the material to be classified, and the anterior edges 3 classify the material and allow it to pass, or turn it back over edge 2 of the piece 1 located immediately after the first one.

It is observed, therefore, that one of the principal characteristics of this invention is that each screen bed is made up of a multiple number of longitudinally elongated pieces 1, each one of them having its down-stream edge, with respect to the direction of advance of the material, equipped with a multiple number of notches alternating with projections.

On each anterior edge 3, also called the "active edge", these projections 5 and notches 4 which alternate with them, have no reason to be regular, nor do the projections need to have standardized dimensions, as this edge 3 can be made up of a series of irregularities which determine said spaces and projections, even with variable dimensions.

The other condition, highly important to the invention, is that each piece 1 must be located above the other, in a staggered manner, as is shown in FIG. 2. In effect, it is noted in this figure that a piece 1 is located above and off-set or staggered, without touching the next piece 1. In other words, the piece 1 located upstream is always higher than the one located downstream, but without touching it. From this, we see another important condition for purposes of the invention, and this is that the pieces 1 must be stationary during operation in their relative positions.

Thus, the distance between the anterior edge, according to the perpendicular line XX' and the posterior edge, according to perpendicular line YY' of the piece immediately following, i.e., distance "a" of FIG. 2, can be variable and be programmed for the grain size to be classified, without constituting a variable of performance demanded for the purposes of the invention. In effect, this distance "a" can range in value from a negative amount (overlapping), through zero (coincidence of lines XX' and YY'), until it reaches positive values, as is shown clearly in FIG. 2, without thereby departing from the scope of the invention. This is also to be seen in FIG. 3.

Figure 6:
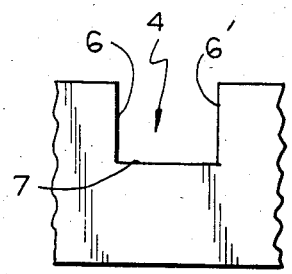

The other important condition of the invention, to be fulfilled strictly, is to be observed in the fact that each notch presents two facing edges 6 and 6', which join at the bottom 7 of notch 4, and said edges must always be divergent from the aforesaid bottom 7, toward the anterior edge 3, and at most, as a limiting condition, said edges can be parallel to each other, as is shown in FIG. 6. As clearly seen in FIG. 6, the edges 6 and 6' cannot be convergent in this case.

The shape adopted for the bottom 7 likewise has no fundamental importance, and the selection of the profile of the bottom and of edge 6 is another variable in order to achieve the most appropriate selection or screening.

In FIG. 4, we see the operating condition, as follows: the material to be classified passes, or does not pass, through the openings determined between the two points N and M, substantially opposite and aligned, pertaining to the edges 6' and 6, respectively, of each notch 4 and the area defined by these two points and point P pertaining to the posterior edge of the following piece 1. In FIG. 4, this area is shadowed to comprise the triangle of minimum passing thickness, (triangle B-B-C), the maximum size being determined by the minimum theoretical sphere inscribed by the three aforementioned points M, N and P.

The size of the mesh or opening is determined by regulating the following variables, peculiar to the invention, and assuming the width and length of the frame to be constant, and likewise the number of jolts or vibrations per minute:

The shape or profile of notches 4 and the edges thereof 6 and 6'.

The quantity of projections and the profile of same.

The separation "a" of each piece 1.

The shape of the piece 1, i.e., flat, corrugated, with depressions, and ridges, etc. (These have not been illustrated, but it is easy to imagine a depression corresponding to each projection 5, and a ridge for each root or bottom of notch 4.)

On the basis of these variables, the magnitude of the minimum and maximum area (with respect to the triangle, B, B, C, and the theoretical sphere passing through the points M, N, P) are determined for each notch 4, assuming them to be equal and uniform, a condition which need not necessarily be fulfilled, as is noted above.

In this manner, a new classification screen is presented, having a very effective classification capacity, a very low consumption of power, and a refined capacity for regulation.

Likewise, in FIG. 2, there is observed a structural detail consisting of a longitudinal ridge 8 which creates a step in the posterior edge 2, which prevents the vibrations of the machine from causing the material to be classified from moving backwards.

In FIGS. 7 and 9, respectively, there are shown two additional embodiments of this invention. In FIG. 7, it is seen that the projections 5 present a polygonal conformation, corresponding to the notches 4, the edges 6 and 6' being straight and the end 9 of projection 5 being truncated.

In FIG. 9, we observe an embodiment consisting in the fact that each piece 1 possesses primarily a horizontal plane which contains the positions 2 and 3 mentioned above, and then it is bent in a basically vertical direction, downward, in position 11, thus defining an opening or notch 12.

FIG. 9 illustrates the version in which each piece 1 is formed by a dual succession of pieces, with the free ends 13 of the projections 5 directed downward.

In FIG. 8, we observe another regulation of the mesh size according to the invention, consisting of the addition of extra surfaces 10 on each portion 2 of the longitudinal pieces 1, and therefore we find varied the size of the triangle M, N, P, and of the theoretical minimum sphere, substantially represented by the shaded area in FIG. 4 by the forward edge of additional piece 10.

These additional pieces can be attached individually to each portion of 2, or they can rest on the latter, and be regulated in unison by a known method, such as a deformable parallelogram, etc.

While only a few embodiments of the present invention have been shown and described, it will be obvious that many changes and modifications may be made thereto without departing from the spirit and scope of the present invention.

What is claimed is:

1. An adjustable classification screen for use with a machine which is provided with at least one screening bed subject to a vibrational movement and having a surface at least part of which is provided with a multiple number of passages for screening material, said classification screen comprising a plurality of substantially laminar elongated pieces stationary with respect to each other, each of said pieces being staggered with respect to the succeeding elongated piece without touching it, each of said pieces defining planes substantially parallel to each other, each of said pieces being located at a higher elevation than the piece which follows it with respect to the direction of advance of the material being screened to define a space separating the planes thereof, each of said pieces being substantially rigid and having a planar edge on one side of a planar portion, said planar portion having a portion of surface which is substantially free from any opening and an active edge on the side of the planar portion opposite the planar edge and having a plurality of projections which define alternating spaces, said projections defining notches having two sides in said active edge between each pair of projections, said pieces oriented with respect to the direction of advance of the material so that the material passes onto said planar portion first, and then onto said active edge, each of said pieces being inclined so that said planar portion is at a higher elevation than said active edge, each of said notches providing two points disposed on each side thereof, said points and a third intermediate point disposed on the planar edge of the piece located immediately adjacent to the active edge on the same bed, said third point being equidistant from each of said two points, said three points lying in a plane inclined in the direction of material advance so as to determine a passage greater than the space separating the planes of said pieces and defining a maximum mesh size of the screen, and a plurality of additional pieces each having a rearward edge and being slidably mounted onto a corresponding elongated piece, so that said additional piece may be reversably moved over the planar edge of the corresponding elongated piece to thereby adjustably reduce the size of said passage and providing said screen with a variable mesh size.

2. The classification screen according to claim 1, wherein said additional surfaces are linked together and are regulated in unison to provide uniform displacements over each one of the elongated pieces.

* * * * *